United States Patent [19]

Tomka

[11] 4,284,709

[45] Aug. 18, 1981

[54] PROCESS FOR INCORPORATING PHOTOGRAPHIC ADDITIVES IN HYDROPHILIC COLLOID PREPARATIONS

[75] Inventor: Ivan Tomka, Bourguillon, Switzerland

[73] Assignee: Ciba-Geigy Aktiengesellschaft, Basel, Switzerland

[21] Appl. No.: 147,785

[22] Filed: May 8, 1980

[30] Foreign Application Priority Data

May 15, 1979 [CH] Switzerland ..... 4503/79

[51] Int. Cl.[3] ..... G03C 1/10; G03C 1/06

[52] U.S. Cl. ..... 430/222; 430/377; 430/493; 430/512; 430/546; 430/559; 430/566; 430/569; 430/627; 430/628; 430/629; 430/631; 430/636; 430/637; 430/541; 430/544; 430/570; 430/606; 430/607

[58] Field of Search ..... 430/546, 377, 627, 493, 430/628, 559, 629, 449, 566, 631, 222, 569, 636, 223, 637, 512

[56] References Cited

U.S. PATENT DOCUMENTS

| | | | |
|---|---|---|---|
| 3,525,620 | 8/1970 | Nishio | 430/637 |
| 3,644,119 | 2/1972 | Jones | 430/627 |
| 3,895,950 | 7/1975 | Geiger | 430/637 |
| 4,198,478 | 4/1980 | Yoneyama | 430/546 |

*Primary Examiner*—Mary F. Downey

*Attorney, Agent, or Firm*—Sprung, Felfe, Horn, Lynch & Kramer

[57] ABSTRACT

A process for incorporating photographic additives which are sparingly soluble to insoluble in water into a free-flowing, aqueous preparation which contains a hydrophilic colloid and is used to prepare photographic layers, by mixing the photographic additives with a combination of at least one non-ionic alkylphenol/alkylene oxide or diphenolmethane/alkylene oxide adduct and at least one anionic esterification product of these adducts and, optionally, a water-immiscible solvent and then finely dispersing this mixture in an aqueous solution of the hydrophilic colloid, which solution contains further water-soluble or dispersed water-insoluble constituents optionally.

Spontaneous emulsions of the photographic additives with good fine dispersion are obtained in this way without high expenditure of mechanical energy. The emulsions are suitable for the preparation of photographic layers, which are used in photographic materials with improved characteristics.

20 Claims, No Drawings

PROCESS FOR INCORPORATING PHOTOGRAPHIC ADDITIVES IN HYDROPHILIC COLLOID PREPARATIONS

The present invention relates to a process for incorporating photographic additives which are sparingly soluble to insoluble in water into free-flowing aqueous preparations which contain a hydrophilic colloid and are suitable for the preparation of photographic layers.

Processes which have as their aim the fine dispersion of water-insoluble photographic additives in an aqueous colloid solution have been disclosed in a large number of publications. The normal method, i.e. dissolving the water-insoluble photographic additive in an organic solvent and then preparing a finely dispersed emulsion is described, for example, in U.S. Pat. Nos. 2,332,027, 2,360,290, 2,728,659, 2,739,888, 3,352,681, 3,676,141, 3,700,543 and 3,860,425 and also in German Offenlegungsschriften 2,619,248, 2,647,487 and 2,820,092.

However, more or less severe difficulties are encountered.

If, for example, solutions of water-insoluble photographic additives in water-miscible solvents are mixed with an aqueous solution of a hydrophilic colloid, the water-insoluble substance is in most cases precipitated in an uncontrollable manner and coarse agglomerates, which cannot be used in a photographic layer, are then obtained instead of the desired fine and uniform dispersion. For this reason, water-miscible solvents are used only in specific cases where their action is foreseeable and desired, for example when introducing spectral sensitisers. In this case, controlled precipitation and adsorption on the photographic silver halide grain is obtained by the use of very dilute solutions, such as in alcohols or acetone.

In most cases, however, it proves necessary to dissolve the water-insoluble additives in solvents which are immiscible with water and to add the additives in this form to the aqueous colloid solution. In order in this case to achieve a fine dispersion of the substance added, powerful mechanical forces (shearing forces) such as are produced, for example, in a colloid mill or an ultrasonic apparatus, are as a rule required in order finely to disperse the organic phase, which is immiscible with water, in the aqueous colloid solution. In order to ensure that the dispersion which forms is sufficiently fine and is stable for a prolonged period, it is generally necessary also to add additional emulsifiers or dispersants, the composition of which must be suited in an optimum manner to the conditions prevailing in the particular case and in particular to the composition of the aqueous phase and of the organic phase.

The organic solvents used can be non-volatile oils, such as tricresyl phosphate, mixtures of alkylated triphenyl phosphates or dibutyl phthalate, which after drying remain in the layer in the form of fine droplets containing the dissolved substance. However, it is also possible to use volatile solvents, such as esters, ketones, ethers or alcohols, which are removed with the water from the layer during the drying operation. In many cases, at least some of the volatile solvent is also removed from the emulsion again, by evaporation, after the preparation of the finely dispersed emulsion and before the latter is introduced into the colloid solution. This is carried out on the one hand in order to facilitate recovery of the solvent and on the other hand also to increase the storage stability of the emulsion and so that the layer composition is not loaded with too great a volume of inactive substances.

The use of specific solvents, in particular those which because of their composition are suitable for preventing the substances dissolved therein from crystallising out, is described, for example, in U.S. Pat. Nos. 3,748,141, 3,779,763 and 3,996,094, in German Offenlegungsschriften Nos. 2,447,175 and 2,538,889, in Japanese Patent Applications Nos. 51,026,037, 51,149,028, 52,024,715 and 52,093,329 and in Research Disclosures Nos. 15,855, 16,755 and 17,127.

Since the use of solvents is, per se, undesirable for various reasons, it has also already been proposed to achieve the fine dispersion of the water-insoluble organic substances by other means. Thus, German Offenlegungsschrift No. 2,609,742 proposes fine grinding of the water-insoluble additives, such as sensitisers or stabilisers, without the addition of solvents, in the presence of dispersants in a sand mill. In this case, the grinding operation can also be followed by spray-drying or freeze-drying, in order to obtain a stable dry preparation. German Offenlegungsschrift No. 2,551,841 describes a process in which the water-insoluble substances are dissolved in a fatty acid with melting and are then dispersed by introducing into the aqueous solution of a base, it being possible also to add further dispersants if desired.

All of these known processes have the disadvantage that fine dispersion of the water-insoluble substances to an extent such that the particles are sufficiently small for photographic purposes can be achieved only with the use of considerable mechanical energy. If adequate activity of the dispersed substances is to be ensured, the particles must, according to experience, at their largest, be of the order of size of the silver halide particles used in photographic materials, i.e. approximately in the range between 0.1 and 2$\mu$. The dispersions must also be so stable that this size distribution remains unchanged over a prolonged period.

The object of the present invention is to provide a process for incorporating photographic additives which are sparingly soluble to insoluble in water into aqueous colloid solutions, which process results, with very low expenditure of mechanical energy, in finely dispersed emulsions which are stable for any desired length of time.

According to the present invention, the object is achieved by mixing the photographic additives with a combination of dispersants and then finely dispersing the mixture in an aqueous preparation of the hydrophilic colloid.

The present invention therefore relates to a process for incorporating photographic additives which are sparingly soluble to insoluble in water into a free-flowing, aqueous preparation which contains a hydrophilic colloid and is used to prepare photographic layers, which comprises mixing the photographic additives with (a) at least one dispersing assistant of the formula

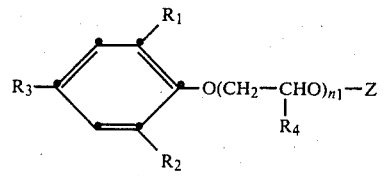

(I)

-continued or (2)

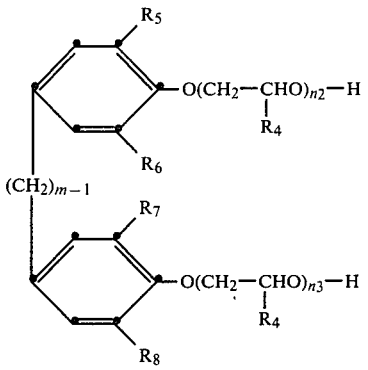

or (3)

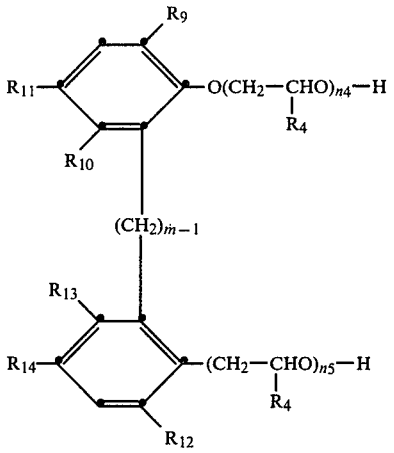

(b) at least one dispersing assistant of the formula (4)

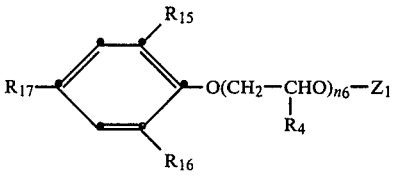

or (5)

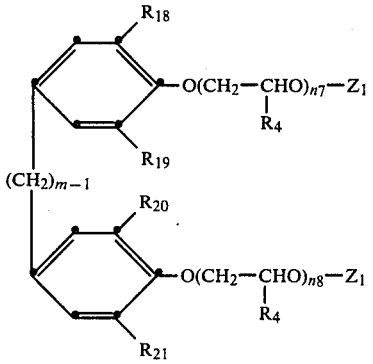

or

-continued (6)

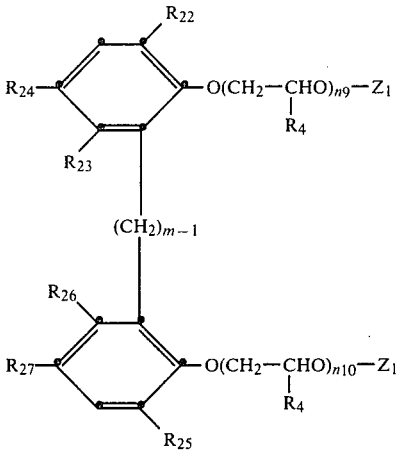

in which $R_1$, $R_2$ and $R_3$ are each hydrogen, chlorine, bromine, alkyl having 1 to 8 carbon atoms, which can be substituted by phenyl, or cycloalkyl having 5 or 6 carbon atoms, $R_4$ is hydrogen or methyl, $R_5$ to $R_8$ are each hydrogen, chlorine, bromine or alkyl having 1 to 8 carbon atoms, $R_9$ to $R_{14}$ and $R_{22}$ to $R_{27}$ are each hydrogen, chlorine or bromine and $R_{15}$ to $R_{21}$ are hydrogen, chlorine, bromine or alkyl having 1 to 30 carbon atoms, at least one of the radicals $R_1$, $R_2$ or $R_3$ being alkyl having at least 3 carbon atoms or cycloalkyl having 5 or 6 carbon atoms, at least one of the radicals $R_{15}$ to $R_{17}$ and at least two of the radicals $R_5$ to $R_8$ and at least two of the radicals $R_{18}$ to $R_{21}$ being alkyl having at least 3 carbon atoms, the sum of the carbon atoms in the radicals $R_5$ to $R_8$ and $R_{18}$ to $R_{21}$ being at least 8 in each case and at least 50% of all the $R_4$ radicals in the formulae (1) to (6) being hydrogen, Z is hydrogen or

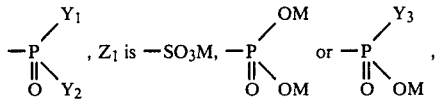

$Y_1$, $Y_2$ and $Y_3$ are each a radical of the formula

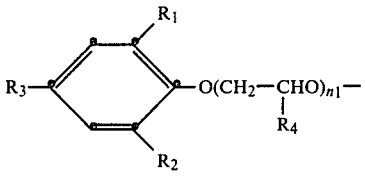

M is hydrogen, an alkali metal or ammonium, m is an integer from 1 to 5 and $n_1$ is an integer from 4 to 100, $n_2$ to $n_5$ are integers and the sum of $(n_2+n_3)$ and of $(n_4+n_5)$ is 8 to 200 in each case, $n_6$ is an integer from 1 to 60 and $n_7$ to $n_{10}$ are integers and the sum of $(n_7+n_8)$ and of $(n_9+n_{10})$ is 2 to 40 in each case, and, optionally, (c) a solvent which is immiscible with water and then finely dispersing the mixture in an aqueous solution of the hydrophilic colloid, which, optionally, contains further water-soluble or dispersed water-insoluble constituents.

The present invention also relates to the photographic layers prepared and to photographic materials which contain these layers.

The photographic additive can be, inter alia, a dye (for example an image dye, filter dye, antihalo dye or acutance dye), a dye-donating substance for the colour diffusion transfer process, a chromogenic colour coupler, a DIR compound, a stabiliser, a spectral sensitiser, a desensitiser, a UV absorber, a light stabiliser, a fluorescent brightener, a solubilising agent, a bleaching catalyst for the silver dye-bleach process, a developer or a crosslinking agent.

Preferred dispersing assistants of the formula (I) are those in which $R_1$, $R_2$ and $R_3$ are each hydrogen, alkyl having 1 to 5 carbon atoms, cyclohexyl or phenylalkyl having 1 or 2 carbon atoms in the alkyl radical, at least one of these radicals being alkyl having at least 3 carbon atoms and the sum of the carbon atoms in these radicals being at least 4, $R_4$ is hydrogen or methyl and Z is hydrogen or $—P(O)Y_1Y_1$, in which $Y_1$ is a radical of the formula

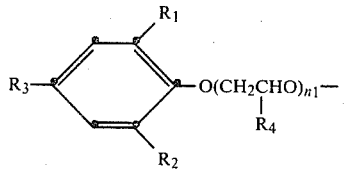

$R_1$, $R_2$, $R_3$ and $R_4$ are as defined and $n_1$ is an integer from 4 to 100 and preferably from 4 to 60.

Preferred dispersing assistants of the formula (2) are those in which $R_5$ to $R_8$ are each hydrogen or alkyl having 1 to 5 carbon atoms, at least two of these radicals being alkyl having, in each case, at least 3 carbon atoms and the sum of the carbon atoms in these radicals being at least 8, and $R_4$ is methyl or preferably hydrogen and m is 2 and the sum of $(n_2+n_3)$ is 8 to 200 and preferably 8 to 80 or 20 to 80.

The alkyl radicals in the preferred compounds of the formulae (1) and (2) are in particular straight-chain and branched alkyl radicals having 1 to 5 carbon atoms, for example methyl, ethyl, propyl, isopropyl, butyl, t-butyl, amyl, isoamyl or tert.-amyl.

Preferred dispersing assistants of the formula (3) are those in which $R_9$ to $R_{14}$ are each chlorine or bromine, $R_4$ is methyl or preferably hydrogen and m is 2 and the sum of $(n_4+n_5)$ is 8 to 200 or preferably 8 to 40 or 20 to 40.

Preferred dispersing assistants of the formula (4) are those in which $R_{15}$ to $R_{17}$ are each hydrogen or alkyl having 1 to 12 carbon atoms, at least one of these radicals being alkyl having at least 3 carbon atoms and the sum of the carbon atoms in these radicals being at least 4, and $R_4$ is methyl or preferably hydrogen and $Z_1$ is $—SO_3M$, $n_6$ is an integer from 1 to 50 or 1 to 20 and M is as defined.

The alkyl radicals $R_{15}$ to $R_{17}$ are, for example, methyl, ethyl, n-propyl, n-butyl, n-amyl, n-hexyl, n-heptyl, n-octyl, n-nonyl, n-decyl, n-undecyl or n-dodecyl and also the corresponding isomers with secondary and tertiary carbon atoms.

Preferred dispersing assistants of the formula (5) are those in which $R_{18}$ to $R_{21}$ are each hydrogen or alkyl having 1 to 5 carbon atoms, at least two of these radicals being alkyl having, in each case, at least 3 carbon atoms and the sum of the carbon atoms in these radicals being at least 8, and $R_4$ is hydrogen or methyl and m is 2, the sum of $(n_7+n_8)$ is 2 to 40 and $Z_1$ is $—SO_3M$, in which M is as defined.

Examples of the alkyl radicals $R_{18}$ to $R_{21}$ are those already given for the compounds of the formula (2).

Preferred dispersing assistants of the formula (6) are those in which $R_{22}$ to $R_{27}$ are each chlorine or bromine, $R_4$ is hydrogen or methyl, m is 2 and $Z_1$ is $—SO_3M$, the sum of $(n_9+n_{10})$ is 2 to 40 and M is as defined.

The compounds of the formulae (1) to (6) are compounds which can be prepared by known methods (for example ethoxylation/propoxylation of phenols or bisphenols, followed by an esterification if necessary) (cf., for example, U.S. Pat. Nos. 3,583,486 and 3,659,650 and German Patent Specifications Nos. 2,300,860 and 1,287,556).

If both ethylene oxide and propylene oxide are added on, it is advantageous to add on the two alkylene oxides in phases separated with respect to time, so that the alkenoxy chains formed on the phenol groups have separate "blocks" consisting of one or more ethenoxy or propenoxy units. The properties of the resulting non-ionic dispersants can be controlled within wide limits by the choice of the chain length and of the ratio of the amount of ethylene oxide to propylene oxide added on and also by the chain length and by the number and the position of the alkyl substituents on the phenyl nucleus. The solubility in water and the dispersant characteristics depend to a large extent on the length of the alkenoxy chains and on the number of carbon atoms in the alkyl substituents. In addition, the number of propenoxy units added on must be not more than equal to, but preferably less than half, the number of ethenoxy units if the compounds are to be sufficiently hydrophilic.

The compounds of the formulae (4) to (6) are prepared by esterification of the compounds of the formulae (1) (if Z in formula (1) is hydrogen) to (3), preferably with sulfuric acid or phosphoric acid. The preparation of the sulfuric acid esters by reaction with sulfamic acid or sulfur trioxide is described, for example, in N. Schönfeldt, "Grenzflächenaktive Aethylenoxyaddukte" ("Surface-active Ethylene Oxide Adducts"), Stuttgart, 1976, page 919 et seq.

The dispersants of the formulae (1) to (3) (non-ionic dispersants) on the one hand and those of the formulae (4) to (6) (acid esters) on the other hand are used in weight ratios of between 1:0.01 and 1:1 and preferably of between 1:0.05 and 1:0.2; the weight ratio of the substance to be dispersed and the dispersant (total of the compounds of the formulae (1) to (6)) is chosen between about 1:0.1 and 1:4.

Mixtures of dispersants of the formula (1) and of the formula (4) are particularly preferred.

The weight ratio of the water-insoluble phase (photographic additive/dispersing assistant and, if desired, solvent) to the aqueous colloid solution is as a rule between 1:5 and 1:100. For the preparation of the dispersions, the oily phase is first prepared by dissolving the water-insoluble photographic additives, for example dyes, couplers or UV absorbers, in a mixture of at least one dispersant of the formulae (1) to (3) and at least one dispersant of the formulae (4) to (6), and in particular of the formula (4), at room temperature or slightly elevated temperatures (20° to 50° C.). Dispersants in solid form are melted, for example at 40° to 120° C., for this purpose. In order to facilitate the dissolving process, it is necessary in many cases also to add a solvent. Suitable solvents are, in particular, solvents which have a solubility parameter of less than 13 and are essentially immiscible with water. With respect to the determination and the definition of the solubility parameter see J. Brandrup and E. H. Immergut "Polymer Handbook", Interscience Publishers, New York/London/Sydney, 3rd edition 1967, pages IV-341 et seq.

Examples of suitable solvents are hydrocarbons, halogenated hydrocarbons, higher alcohols, esters, ethers, nitriles or ketones, especially pentane, hexane, heptane, octane, nonane, decane, tetrahydronaphthalene, decahydronaphthalene, cyclohexane, benzene, toluene, xylene, chlorobenzene, bromobenzene, dichlorobenzene, nitrobenzene, methylene chloride, chloroform, carbon tetrachloride, trichloroethylene, butanol, pentanol, hexanol, cyclohexanol, ethyl acetate, propyl acetate, butyl acetate, amyl acetate, ethyl propionate, cyclohexanone, methyl isobutyl ketone, acetonitrile, ethoxyethanol, tricresyl phosphate or dibutyl phthalate.

Solvents are in general to be regarded as ballast substances since they have no photographic function; the amount used will therefore be only that which is required to dissolve the substance, to be dispersed, in the oily phase or to prevent its crystallising out in the dispersion. In practice, the amount used should hardly exceed about ten times the weight of the substance to be dispersed.

The next step in the preparation of the dispersions comprises the dispersion of the oily phase in the aqueous phase, in such a way that finally a finely dispersed oil-in-water emulsion forms. According to the invention, this step is carried out without the use of substantial amounts of mechanical energy, i.e. without the use of the colloid mills, high-pressure dispersing pumps or ultrasonic devices, which are otherwise customary. If the dispersants of the formulae (1) to (6) and the solvent, and also the ratios of the components, have been selected as indicated, the fine dispersion of the oily phase takes place virtually spontaneously and can, for example, be effected by simple shaking or stirring by means of a static mixer, or also by means of a lowfrequency vibrator. Experience has shown that it is advantageous gradually to add the aqueous phase to the oily phase; however, the procedure can also be reversed.

The aqueous phase advantageously contains a protective colloid. In view of the intended use for the preparation of photographic layers, gelatin will preferably be employed. However, it is also possible to use other protective colloids, in particular water-soluble high molecular weight substances such as casein, water-soluble derivatives of cellulose and other high molecular weight carbohydrates, alginates, polyvinyl alcohol, polyvinylpyrrolidone, polyvinyl methyl ether or graft copolymers of gelatin with water-soluble esters of acrylic acid, methacrylic acid, maleic acid or itaconic acid. The aqueous phase can also contain further substances required for the build-up of photographic layers, such as silver halides, colloidal silver, water-soluble constituents, such as stabilisers or hardeners, wetting agents and also finely dispersed water-insoluble polymers, for example polyacrylates; in a somewhat modified procedure, however, the oily phase can also be dispersed, according to the invention, in water which contains some of the gelatin required for the build-up of the layers, the dispersion thus obtained subsequently being mixed with the remainder of the aqueous phase.

The oil-in-water emulsions prepared according to the invention differ from emulsions prepared conventionally using mechanical means not only in that they have greater stability but also in respect of the particular type of particle size distribution which results. Whilst in the case of conventionally prepared emulsions the particle size distribution usually follows a Gaussian normal distribution or logarithmic normal distribution, the distribution parameters of which essentially depend on the mechanical means used and on the energy expended, the distribution in the case of the emulsions according to the invention, which form virtually spontaneously, in general follows a Poisson function and is independent of the mechanical energy expended (cf. W. Feller, An Introduction to Probability Theory and its Applications, Volume I, Second Edition, page 146 et seq., John Wiley and Sons, New York/London/Sydney). In particular, it is possible by means of the process according to the invention to produce a fine dispersion with average particle sizes far below one $\mu$m; with the conventional process this could be achieved only with very major technical effort and correspondingly high costs.

The conventional measurement procedures such as sedimentation analysis, turbidity measurement or the counting of images produced in an optical microscope or electron microscope can be used to measure the particle size distribution. The occurrence of a Poisson distribution function, the characteristic feature of which is that it is completely defined by a single parameter (in this case the average particle size or particle volume), can serve as reliable confirmation that the emulsion is a spontaneous emulsion prepared according to the invention. In contrast to these emulsions, mechanically prepared emulsions with a Gaussian normal or log-normal distribution require two parameters to describe the distribution characteristics, that is to say the average particle size and the standard deviation.

Volatile solvents which are also used in the preparation of the oily phase escape at the latest together with the evaporating water from the layer during drying. In general, however, it will be preferred to recover the solvents again even before the photographic layers are prepared. This can be effected either by partial evaporation of the oily phase prior to emulsifying or by partial evaporation of the oil-in-water emulsion, and in the latter case the solvent escapes together with some of the water contained in the outer phase and can be recovered again after separation from the latter. Non-volatile solvents remain, together with the substance dissolved therein, as finely dispersed emulsion droplets in the layer.

Some dispersing assistants of the formulae (1) to (6) and also some conventional photographic additives which can be employed in the process according to the invention are listed below.

TABLE 1

Dispersants of the formula (1):

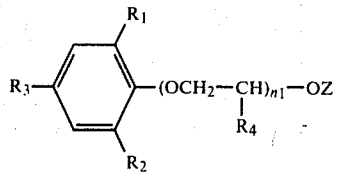

| Compound No. | $R_1$ | $R_2$ | $R_3$ | $R_4$ | Z | $n_1$ |
|---|---|---|---|---|---|---|
| 101 | H | H | t-$C_4H_9$ | H | H | 30 |
| 102 | H | H | t-$C_5H_{11}$ | H | H | 4 |
| 103 | H | H | t-$C_5H_{11}$ | H | H | 30 |
| 104 | H | t-$C_4H_9$ | H | H | H | 4 |
| 105 | H | t-$C_4H_9$ | H | H | H | 30 |
| 106 | t-$C_4H_9$ | H | $CH_3$ | H | H | 4 |
| 107 | t-$C_4H_9$ | H | $CH_3$ | H | H | 30 |
| 108 | t-$C_4H_9$ | t-$C_4H_9$ | H | H | H | 4 |
| 109 | t-$C_4H_9$ | t-$C_4H_9$ | H | H | H | 30 |
| 110 | t-$C_4H_9$ | H | t-$C_4H_9$ | H | H | 4 |
| 111 | t-$C_4H_9$ | H | t-$C_4H_9$ | H | H | 30 |
| 112 | t-$C_5H_{11}$ | H | t-$C_5H_{11}$ | H | H | 4 |
| 113 | t-$C_5H_{11}$ | H | t-$C_5H_{11}$ | H | H | 30 |
| 114 | —$CH_3$ | H | t-$C_4H_9$ | H | H | 4 |
| 115 | —$CH_3$ | H | t-$C_4H_9$ | H | H | 10 |
| 116 | —$CH_3$ | H | t-$C_4H_9$ | H | H | 20 |
| 117 | —$CH_3$ | H | t-$C_4H_9$ | H | H | 30 |
| 118 | —$CH_3$ | H | t-$C_4H_9$ | H | H | 40 |
| 119 | t-$C_4H_9$ | t-$C_4H_9$ | t-$C_4H_9$ | H | H | 4 |
| 120 | t-$C_4H_9$ | t-$C_4H_9$ | t-$C_4H_9$ | H | H | 30 |
| 121 | H | H | t-$C_4H_9$ | H(80%)$CH_3$(20%) | H | 60 |
| 122 | H | H | t-$C_4H_9$ | H | $O{=}P(Y_1)_2$ | 30 |
| 123 | t-$C_4H_9$ | t-$C_4H_9$ | t-$C_4H_9$ | H | H | 8 |
| 124 | t-$C_4H_9$ | t-$C_4H_9$ | t-$C_4H_9$ | H | H | 6 |
| 125 | t-$C_5H_{11}$ | t-$C_5H_{11}$ | H | H | H | 30 |
| 126 | $CH_3$ 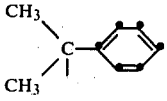 $CH_3$ | $CH_3$ 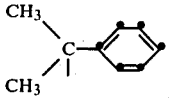 $CH_3$ | H | H | H | 30 |
| 127 | 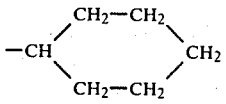 | 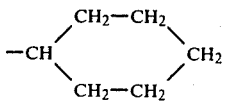 | H | H | H | 30 |
| 128 | t-$C_5H_{11}$ | t-$C_4H_9$ | H | H | H | 30 |
| 129 | t-$C_4H_9$ | —$CH_3$ | t-$C_4H_9$ | H | H | 30 |
| 130 | t-$C_5H_{11}$ | 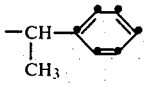 | H | H | H | 30 |
| 131 | s-$C_4H_9$ | t-$C_5H_{11}$ | H | H | H | 30 |
| 132 | s-$C_4H_9$ | i-$C_3H_7$ | t-$C_4H_9$ | H | H | 30 |

$Y_1$ = 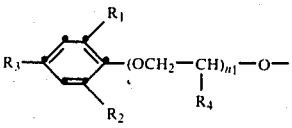

TABLE 2

Dispersants of the formula (2)

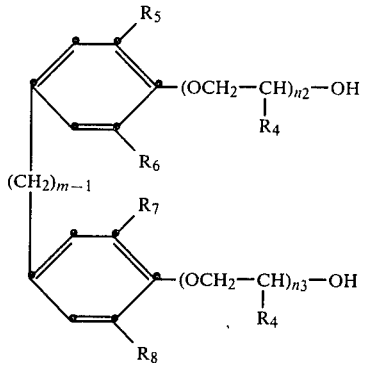

| Compound No. | $R_5$ | $R_6$ | $R_7$ | $R_8$ | $R_4$ | $n_2 + n_3$ | m |
|---|---|---|---|---|---|---|---|
| 201 | t-$C_4H_9$ | t-$C_4H_9$ | t-$C_4H_9$ | t-$C_4H_9$ | H | 20 | 2 |
| 202 | t-$C_4H_9$ | t-$C_4H_9$ | t-$C_4H_9$ | t-$C_4H_9$ | H | 30 | 2 |
| 203 | t-$C_4H_9$ | t-$C_4H_9$ | t-$C_4H_9$ | t-$C_4H_9$ | H | 70 | 2 |

TABLE 3

Dispersants of the formula (3)

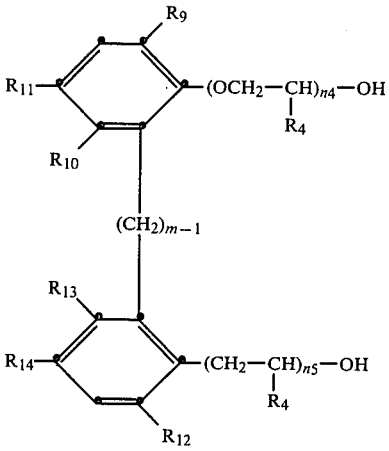

| Compound No. | $R_9$ | $R_{10}$ | $R_{11}$ | $R_{11}$ | $R_{13}$ | $R_{14}$ | $R_4$ | $n_4 + n_5$ | m |
|---|---|---|---|---|---|---|---|---|---|
| 301 | Cl | Cl | Cl | Cl | Cl | Cl | H | 20 | 2 |
| 302 | Cl | Cl | Cl | Cl | Cl | Cl | H | 30 | 2 |
| 302 | Cl | Cl | Cl | Cl | Cl | Cl | H | 70 | 2 |

TABLE 4

Dispersants of the formula (4)

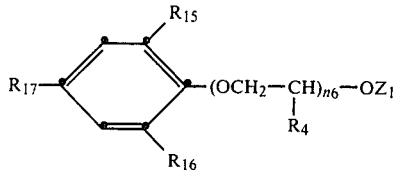

| Compound No. | $R_{15}$ | $R_{16}$ | $R_{17}$ | $R_4$ | $Z_1$ | $n_6$ |
|---|---|---|---|---|---|---|
| 401 | H | H | i-$C_8H_{17}$ | H | $-SO_3Na$ | 3 |
| 402 | H | H | i-$C_8H_{17}$ | H | $-SO_3Na$ | 5 |
| 403 | H | H | i-$C_8H_{17}$ | H | $-SO_4Na$ | 7 |
| 404 | H | H | $C_9H_{19}$ | H | $-SO_3Na$ | 3 |
| 405 | H | H | $C_9H_{19}$ | H | $-SO_3Na$ | 5 |
| 406 | H | H | $C_9H_{19}$ | H | $-SO_3Na$ | 7 |
| 407 | t-$C_4H_9$ | t-$C_4H_9$ | t-$C_4H_9$ | H | $-SO_3Na$ | 2 |
| 408 | t-$C_4H_9$ | t-$C_4H_9$ | t-$C_4H_9$ | H | $-SO_3Na$ | 3 |
| 409 | t-$C_4H_9$ | t-$C_4H_9$ | t-$C_4H_9$ | H | $-SO_3Na$ | 4 |
| 410 | t-$C_4H_9$ | t-$C_4H_9$ | t-$C_4H_9$ | H | $-SO_3Na$ | 5 |
| 411 | t-$C_4H_9$ | t-$C_4H_9$ | t-$C_4H_9$ | H | $-SO_3Na$ | 7 |
| 412 | t-$C_4H_9$ | t-$C_4H_9$ | t-$C_4H_9$ | H | $-SO_3Na$ | 50 |
| 413 | t-$C_4H_9$ | t-$C_4H_9$ | t-$C_4H_9$ | H | $O{=}P(ONa)_2$ | 6 |
| 414 | t-$C_4H_9$ | t-$C_4H_9$ | t-$C_4H_9$ | H | $O{=}P(ONa)_2$ | 8 |
| 415 | t-$C_4H_9$ | t-$C_4H_9$ | t-$C_4H_9$ | H | $O{=}P(ONa)_2$ | 10 |
| 416 | t-$C_4H_9$ | t-$C_4H_9$ | t-$C_4H_9$ | H | $O{=}P(ONa)_2$ | 13 |
| 417 | t-$C_4H_9$ | t-$C_4H_9$ | t-$C_4H_9$ | H | $O{=}P(ONa)_2$ | 18 |
| 418 | t-$C_4H_9$ | t-$C_4H_9$ | t-$C_4H_9$ | H | $O{=}P(ONa)_2$ | 30 |

Photographic Additives

Yellow couplers

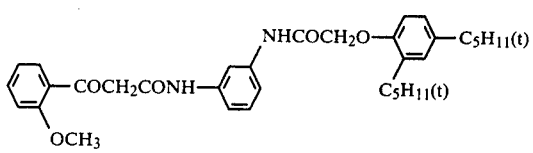

(701)

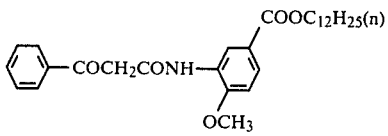

(702)

-continued
Photographic Additives
(703)
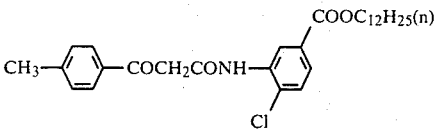
(704)
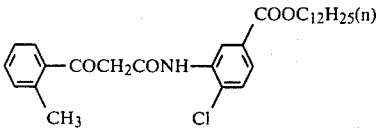
(705)
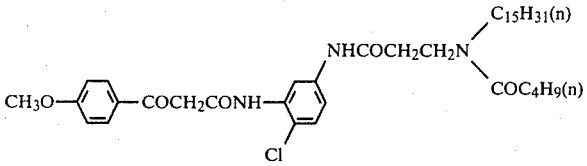
(706)
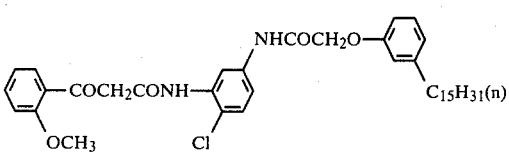
(707)
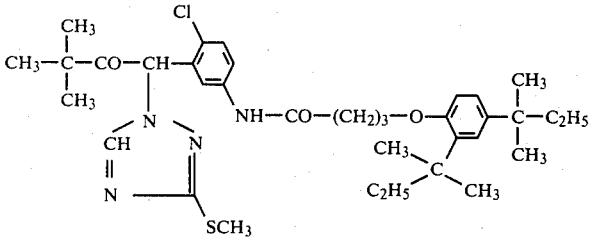
Magenta couplers
(708)
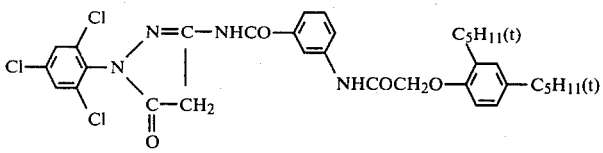
(709)
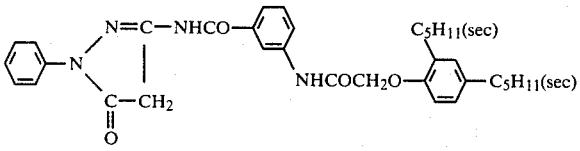
(710)
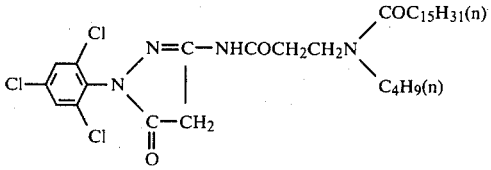
(711)
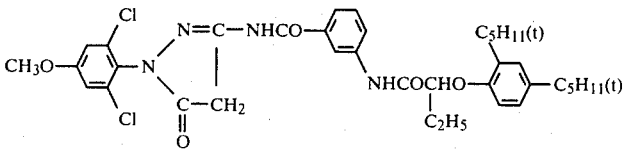
(712)
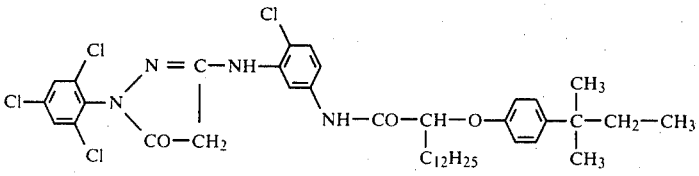

-continued
Photographic Additives
(713)
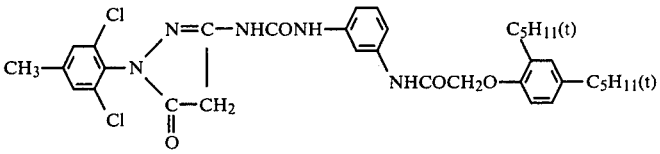
Cyan couplers
(714)
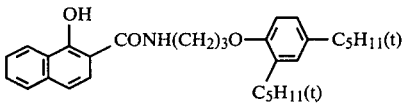
(715)
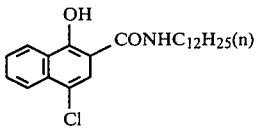
(716)
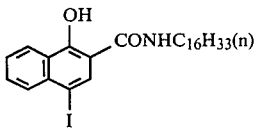
(717)
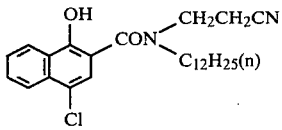
(718)
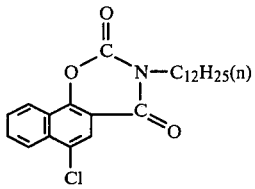
(719)
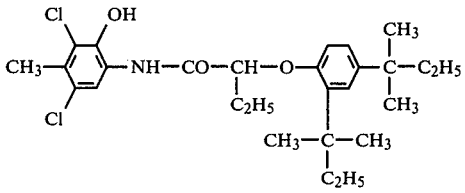
(720)
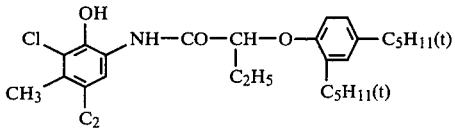
(721)
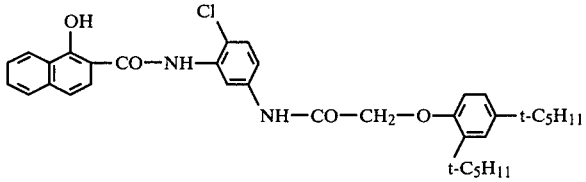
Coloured masking couplers
(722)
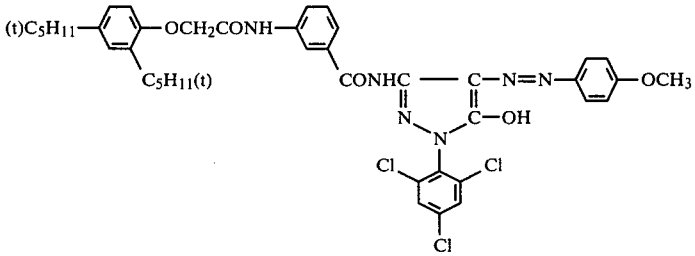

-continued
Photographic Additives
(723)
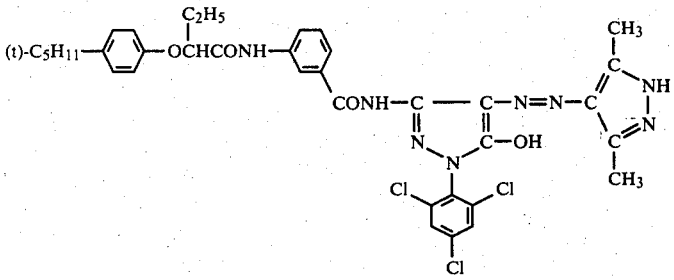
(724)
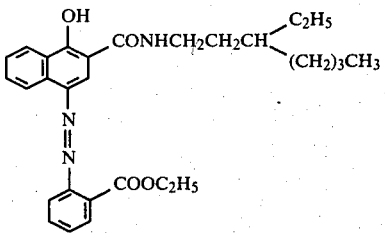
(725)
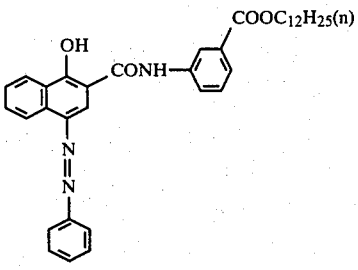
DIR (Development Inhibitor Releasing) couplers
(726)
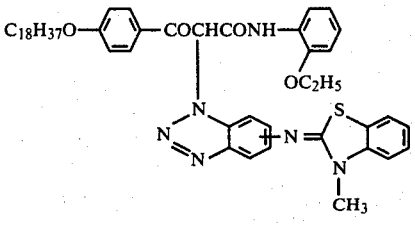
(727)
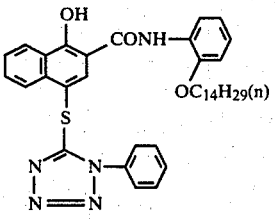
(728)
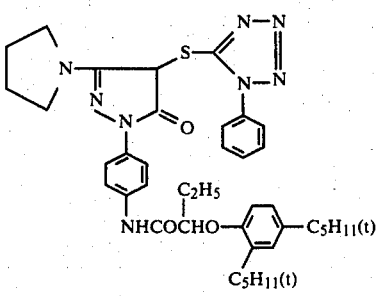
UV absorbers
(729)
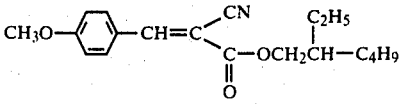

-continued
Photographic Additives
(730)
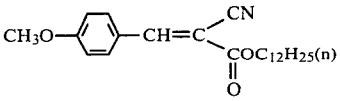
(731)
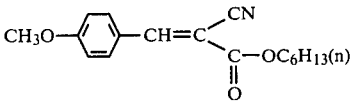
(732)
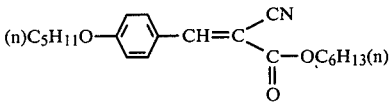
(733)
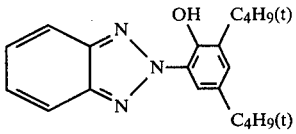
(734)
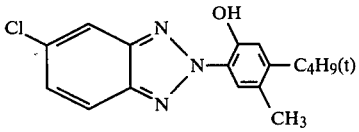
(735)
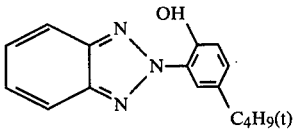
Antioxidants and light stabilisers
(736)
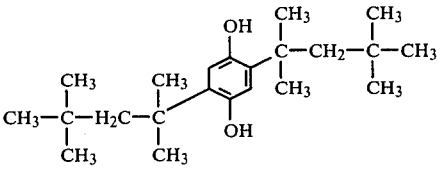
(737)
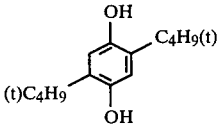
(738)
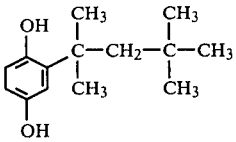
(739)
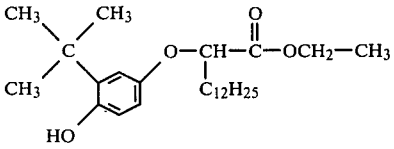
Image dyes
(740)
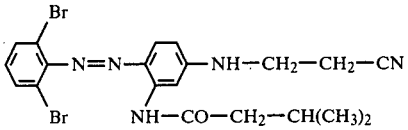
(741)
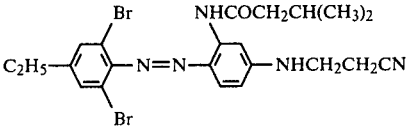
Dye-releasing redox compounds -continued
Photographic Additives
(742)
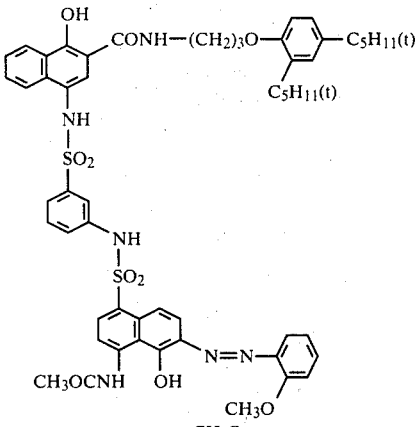
(743)
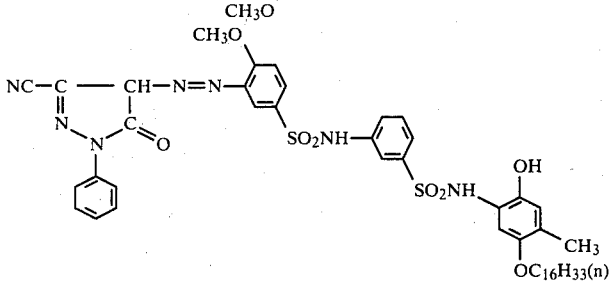
(744)
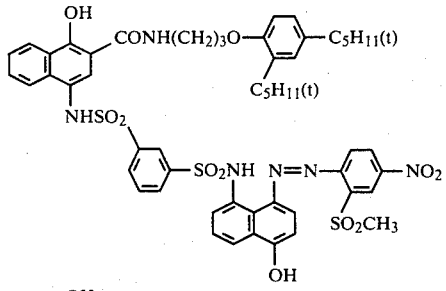
(745)
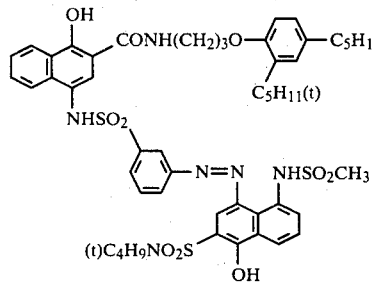
(746)
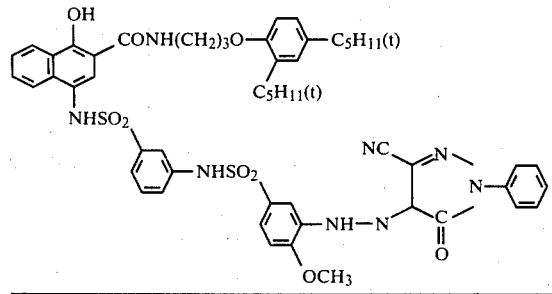
In the examples which follow parts and percentages are by weight unless indicated otherwise.
EXAMPLE 1
Using the oil-soluble magenta coupler of the formula (712), three emulsion batches are prepared using different dispersant/coupler ratios, corresponding to the following compositions:

| | A | B | C |
|---|---|---|---|
| Colour coupler | 320 | 260 | 200 |
| Compound (120) | 170 | 170 | 170 |
| Compound (411) | 25 | 25 | 25 |
| Gelatin | 250 | 250 | 250 |
| Water | 5,235 | 5,295 | 5,355 |
| | 6,000 parts | 6,000 parts | 6,000 parts |

The coupler and the two dispersants of the formulae (120) and (411) are melted together at a temperature of 50° C. and the melt is then mixed together with the aqueous gelatin solution at a temperature of 40° C., with gentle stirring. Mixing of the two phases can also advantageously be carried out by means of a static mixer. A mixer of this type consists, for example, of a cylindrical tube in which a number of helical deflection elements have been installed, these elements each being twisted at 90° relative to one another over short intervals. Such mixers are suitable for homogeneous mixing of phases which are miscible with one another. If it is attempted to prepare emulsions of immiscible liquids using such an apparatus, at best a coarsely disperse emulsion which separates out again within a short time is obtained in the normal case, whilst with the process according to the invention a finely dispersed stable emulsion forms.

For comparison with the process according to the invention, an emulsion D is prepared in the conventional manner and in the following composition, using the same coupler:

| | |
|---|---|
| Magenta coupler of the formula (712) | 320 |
| Tricresyl phosphate | 460 |
| Ethyl acetate | 6,000 |
| Alkylaryl polyglycol ether sulfate (surfactant) | 30 |
| Gelatin | 250 |
| Water | 8,000 |
| | 15,060 parts |

The coupler is dissolved in the mixture of tricresyl phosphate and ethyl acetate and the resulting solution is then first coarsely dispersed in the solution, which has been warmed to 40° C., of gelatin and the surfactant in water (for example by means of a stirrer or of a static through-type mixer). Fine dispersion is then carried out, for example by 6 passes through a highpressure homogeniser under about 300 bar.

In an evaporator, for example a thin-film evaporator, the ethyl acetate is virtually completely removed, together with some of the water, from this emulsion and the weight is then adjusted to 6,000 parts by weight with water.

The particle size distribution is then determined for all 4 emulsions A to D, for example by means of turbidity measurement or by measuring and counting an electron micrograph. The following measured values are obtained:

| Emulsion | A | B | C | D |
|---|---|---|---|---|
| Average particle size μm | 0.12 | 0.10 | 0.12 | 0.20 |
| Specific surface area $\left(\frac{cm^2}{cm^3}\right)$ | 50 | 57 | 51 | 30 |

A considerably more finely dispersed coupler emulsion is obtained with far less effort by means of the process according to the invention. Moreover, the emulsion D prepared by the conventional process also contains almost 1.5 parts of ballast substance in the form of the non-volatile tricresyl phosphate per part by weight of coupler. In addition, the high-pressure homogenisation and the evaporation of the solvent require very expensive special equipment, which raises the costs of the conventional emulsifying process to a not insignificant extent.

In place of the coupler, it is also possible to incorporate one of the other abovementioned photographic additives into an aqueous emulsion.

EXAMPLE 2

An emulsion analogous to emulsion C of Example 1 is prepared by using the cyan coupler of the formula (719) in place of the magenta coupler and the compound (405) in place of the compound (411). The average particle sizes and the specific surface area of the disperse phase correspond to the values for emulsion C in Example 1.

EXAMPLE 3

An emulsion analogous to emulsion C of Example 1 is prepared by using the yellow coupler of the formula (707) in place of the magenta coupler and the compound (405) in place of the compound (411). A finely dispersed emulsion with comparable values for the average particle size and the specific surface area is obtained by the same procedure.

EXAMPLE 4

A photographic layer is prepared in the following manner from each of the magenta coupler emulsions A and D prepared according to Example 1 and these layers are tested to determine their photographic characteristics:

| | |
|---|---|
| 90 g | of coupler emulsion, |
| 190 g | of silver bromide emulsion containing 1.4% of silver and 6.0% of gelatin, |
| 120 g | of a 1% solution of the hardener of the formula |

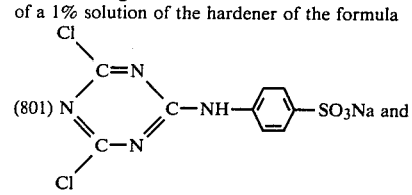

| | |
|---|---|
| 600 g | of water |
| 1,000 g | |

The components are mixed and coated onto a subbed glass plate at a temperature of 40° C. to give a thin layer. The layer is allowed to solidify at 10° C. and is then dried in a stream of air at room temperature.

A strip cut to 4.0 cm×6.5 cm is exposed under a step wedge for 2 seconds with 500 lux and is then treated at 24° C. as follows:

| | Minutes |
|---|---|
| 1. Colour developing | 5 |
| 2. Washing | 5 |
| 3. First fixing | 2 |
| 4. Washing | 2 |
| 5. Silver bleaching | 4 |
| 6. Washing | 2 |
| 7. Second fixing | 4 |
| 8. Washing | 10 |
| 9. Drying | 10 |

-continued

| | | Minutes |
|---|---|---|
| Processing baths | | |
| Developing bath | | |
| 4-Amino-3-methyl-N-ethyl-N-β-(methyl-sulfonamido)-ethyl-aniline . 1½ $H_2SO_4$ . $H_2O$ | | 10 mmols/l |
| anhydrous sodium sulfite | | 2.0 g/l |
| potassium bromide | | 0.5 g/l |
| potassium carbonate | | 40.0 g/l |
| benzyl alcohol | | 10.0 ml/l |
| (pH:10.7) | | |
| Fixing bath (pH = 4.5) | | |
| Sodium thiosulfate . 6 $H_2O$ | | 80.0 g |
| anhydrous sodium sulfite | | 5.0 g |
| sodium borate (borax) | | 6.0 g |
| potassium alum | | 7.0 g |
| acetic acid | | 4.0 g |
| water | to make up to | 1,000 ml |
| Silver bleaching bath (pH = 7.2) | | |
| Potassium ferricyanide (III) | | 100.0 g |
| boric acid | | 10.0 g |
| sodium borate (borax) | | 5.0 g |
| water | to make up to | 1,000 ml |

A clear magenta coloured step wedge is obtained both from the emulsion A according to the invention and from the comparison emulsion D. The following maximum densities are obtained from the densitometric measurement:

| Magenta coupler emulsion used | A | D |
|---|---|---|
| Maximum density of the magneta wedge: | 2.66 | 2.42 |

The dye yield from the coupling (molar extinction of the dye $\epsilon=51{,}500$ at $\lambda_{max}=543$ nm) is determined by extracting the dye formed. In the case of emulsion A according to the invention it is 73% but for the conventional emulsion D, on the other hand, it is only 61%. The higher dye yield and correspondingly higher maximum density of the photographic layer can be explained by the smaller volume of the coupler particles and more rapid penetration of the colour developer during developing of a layer which contains emulsion A.

EXAMPLE 5

(a) 305 g of the yellow coupler of the formula (707) are melted together with the two dispersants of the formulae (120) and (409) in the presence of 120 g of methylene chloride at 50° C. and the resulting melt is mixed with 18 kg of a 5% gelatin solution (gelatin with an isoionic point at a pH value of 8.0) by simple stirring, whereupon a finely dispersed stable emulsion forms spontaneously.

The following mixtures are melted together as indicated under (a) and the resulting melts are mixed with the indicated gelatin solution. Finely dispersed stable emulsions are likewise spontaneously obtained.

(b) 187 g of the cyan coupler of the formula (719), 187 g of the dispersant of the formula (123), 33 g of the dispersant of the formula (409), 11 g of the dispersant of the formula (412) and 110 g of ethyl acetate.

(c) 935 g of the cyan coupler of the formula (719), 935 g of the dispersant of the formula (123) and 130 g of the dispersant of the formula (413).

One of the dispersants of the formulae (414), (415), (416), (417) or (418), or a mixture of two or more of these dispersants, can be used in place of the dispersant of the formula (413), with equal success.

160 g of the magenta coupler of the formula (712), 80 g of the light stabiliser of the formula (739), 12 g of the light stabiliser of the formula (736), 115 g of the dispersant of the formula (120), 9 g of the dispersant of the formula (405) and 37 g of ethyl acetate.

(e) 128 g of the UV absorber of the formula (733), 54 g of the dispersant of the formula (124), 22 g of the dispersant of the formula (123), 8 g of the dispersant of the formula (409) and 55 g of ethyl acetate.

The gelatin used in this example has an isoionic point at a pH value of 5.1.

(f) 230 g of the magenta coupler of the formula (712), 15 g of the dispersant of the formula (405) and 170 g of one of the dispersants of the formulae (105), (108), (113), (116), (120), (125), (126), (127), (128), (129), (130), (131) or (132) are mixed by melting together at slightly elevated temperature and the resulting mixtures are then stirred at 40° C. into a 5% aqueous gelatin solution. In each case a finely dispersed emulsion of the magenta coupler in the gelatin solution forms spontaneously. The use of a conventional volatile or non-volatile coupler solvent is not necessary when preparing these emulsions.

EXAMPLE 6

For a chromogenic black-and-white material the following mixture of colour couplers is mixed with the said dispersants by melting:

168 g of the yellow coupler of the formula (707)
42 g of the cyan coupler of the formula (719)
56 g of the magenta coupler of the formula (708)
14 g of the cyano coupler of the formula (721)
170 g of the dispersant of the formula (120)
10 g of the dispersant of the formula (411)

The mixture is introduced into 5,300 g of a 5% gelatin solution at 40° C., with gentle stirring. A finely dispersed emulsion of the coupler mixture is obtained without further mechanical processing.

A photographic material which after exposure, colour developing and fixing gives a deep black negative image of high covering power can be prepared from this emulsion, by applying it together with a light-sensitive silver halide emulsion to a base.

Examples 7 to 10 relate to photographic coating solutions which are prepared using the spontaneous emulsions described in the preceding examples. They can be used to prepare photographic layers for chromogenic colour materials.

EXAMPLE 7

44 g of the spontaneous emulsion, prepared according to Example (5a), of the yellow coupler of the formula (707) are mixed with 6.67 g of a photographic emulsion which contains 10% of silver bromide and gelatin. The mixture is coated as a uniform layer onto a polyester base, in an amount such that, after drying, a layer forms which contains 13 mg of the yellow coupler, 383 mg of silver bromide and 2,500 mg of gelatin per square meter.

EXAMPLE 8

44 g of the spontaneous emulsion prepared according to Example (5d) are mixed with 7.7 g of a light-sensitive emulsion which contains 6% of gelatin and 10% of silver bromide. The mixture is coated as a thin uniform layer onto a polyester base, in an amount such that, after drying, a layer forms which contains 382 mg of the magenta coupler, 220 mg of the light stabiliser, 442 mg of silver and 2,610 mg of gelatin per square meter.

EXAMPLE 9

44 g of the spontaneous emulsion prepared according to Example (5b) are mixed with 5.75 g of a light-sensitive emulsion which contains 6% of gelatin and 10% of silver bromide. The mixture is coated as a thin uniform layer onto a polyester base, in an amount such that, after drying, a layer forms which contains 444 mg of the cyan coupler, 2,480 mg of gelatin and 330 mg of silver per square meter.

EXAMPLE 10

42.8 g of the spontaneous emulsion described in Example (5e) and 7.8 g of a 5% gelatin solution are mixed together. The mixture is then coated as a uniform thin layer onto a polyester base, in an amount such that, after drying, a layer forms which contains 300 mg of the UV absorber and 2,500 mg of gelatin per square meter.

EXAMPLE 11

(Comparison example)

For comparison, the preparation of the emulsions described in Examples 6 to 10 is repeated using a conventional procedure, the couplers and light stabilisers being dissolved in tricresyl phosphate in each case and the resulting solutions being finely dispersed in a gelatin solution in the conventional manner, by means of a high-pressure homogeniser. The comparison emulsions are mixed, in the same way as the spontaneous emulsions, with a silver bromide emulsion and additional gelatin solution and the resulting mixtures are coated onto a polyester base so that, after drying, photographic layers with the same weight per unit area of gelatin and coupler or light stabiliser are obtained.

The sensitometric tests carried out in the conventional manner show that the layers obtained from the spontaneous emulsions and those obtained from the corresponding comparison emulsions give comparable results; however, it was possible to prepare the spontaneous emulsions obtained according to the invention in a considerably more simple and less expensive manner and, moreover, these emulsions are very stable.

EXAMPLE 12

(a) 25 g of the dye of the formula (740), 120 g of the dispersant of the formula (302) and 40 g of the dispersant of the formula (418) are melted together at slightly elevated temperature and the resulting melt is introduced into 5,000 g of a 5% gelatin solution. A finely dispersed emulsion forms spontaneously on gentle stirring and without further mechanical processing. It is also possible to use an equal amount of the dispersant of the formula (303) in place of the dispersant of the formula (302).

(b) In the manner indicated under (a), 25 g of the dye of the formula (740), 120 g of the dispersant of the formula (302) and 27 g of the dispersant of the formula (418) are melted together and the resulting melt is then introduced into a gelatin solution. A finely dispersed emulsion is again obtained.

EXAMPLE 13

27 g of the dye of the formula (741), 120 g of the dispersant of the formula (203), 27 g of the dispersant of the formula (418) and 50 g of methylene chloride are melted together at slightly elevated temperature and the resulting melt is then stirred with 5,000 g of a 5% gelatin solution.

A very finely dispersed spontaneous emulsion is obtained without further mechanical processing.

Coating solutions which can be coated in thin layers on photographic bases and dried can be obtained from the emulsions according to Examples 12 and 13 by mixing with silver halide emulsions and, if desired, with further additives, for example sensitisers, plasticisers and/or gelatin hardeners. The photographic materials prepared in this way can be processed by the silver dye-bleach process to give coloured images which are fast to light and have good colour reproduction.

What is claimed is:

1. A process for incorporating photographic additives which are sparingly soluble to insoluble in water into a free-flowing, aqueous preparation which contains a hydrophilic colloid and is used to prepare photographic layers, which comprises mixing the photographic additives with (a) at least one dispersing assistant of the formula

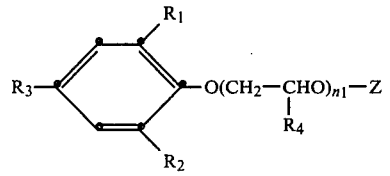

(1)

or

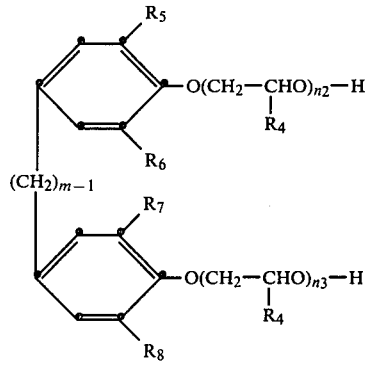

(2)

or

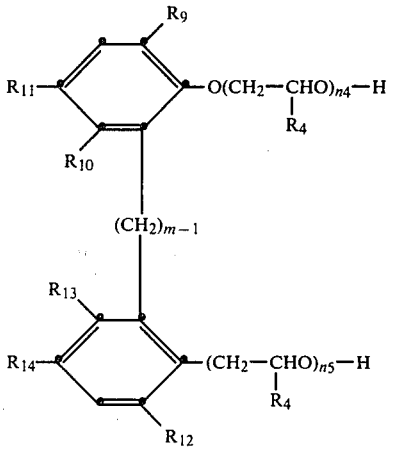

(3)

(b) at least one dispersing assistant of the formula (4)

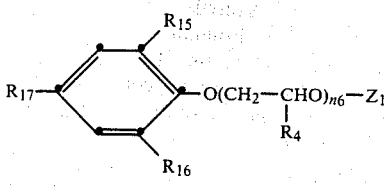

or (5)

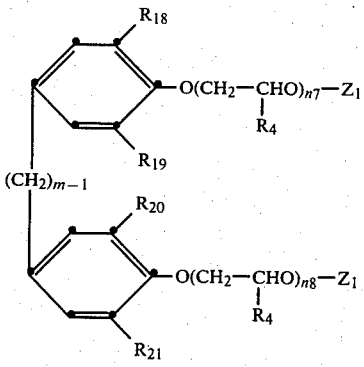

or (6)

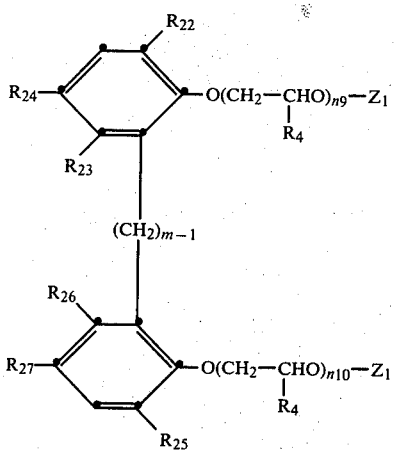

in which $R_1$, $R_2$ and $R_3$ are each hydrogen, chlorine, bromine, alkyl having 1 to 8 carbon atoms, which can be substituted by phenyl, or cycloalkyl having 5 or 6 carbon atoms, $R_4$ is hydrogen or methyl, $R_5$ to $R_8$ are each hydrogen, chlorine, bromine or alkyl having 1 to 8 carbon atoms, $R_9$ to $R_{14}$ and $R_{22}$ to $R_{27}$ are each hydrogen, chlorine or bromine and $R_{15}$ to $R_{21}$ are hydrogen, chlorine, bromine or alkyl having 1 to 30 carbon atoms, at least one of the radicals $R_1$, $R_2$ or $R_3$ being alkyl having at least 3 carbon atoms or cycloalkyl having 5 or 6 carbon atoms, at least one of the radicals $R_{15}$ to $R_{17}$ and at least two of the radicals $R_5$ to $R_8$ and at least two of the radicals $R_{18}$ to $R_{21}$ being alkyl having at least 3 carbon atoms, the sum of the carbon atoms in the radicals $R_5$ to $R_8$ and $R_{18}$ to $R_{21}$ being at least 8 in each case and at least 50% of all the $R_4$ radicals in the formulae (1) to (6) being hydrogen, Z is hydrogen or

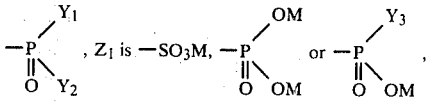

$Y_1$, $Y_2$ and $Y_3$ are each a radical of the formula

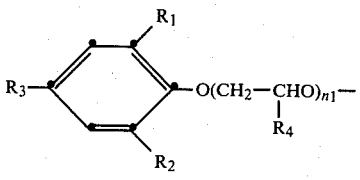

M is hydrogen, an alkali metal or ammonium, m is an integer from 1 to 5 and $n_1$ is an integer from 4 to 100, $n_2$ to $n_5$ are integers and the sum of $(n_2+n_3)$ and of $(n_4+n_5)$ is 8 to 200 in each case, $n_6$ is an integer from 1 to 60 and $n_7$ to $n_{10}$ are integers and the sum of $(n_7+n_8)$ and of $(n_9+n_{10})$ is 2 to 40 in each case, and, optionally, (c) a solvent which is immiscible with water and then finely dispersing the mixture in an aqueous solution of the hydrophilic colloid, which, optionally, contains further water-soluble or dispersed water-insoluble constituents.

2. A process according to claim 1, wherein the photographic additive is a dye, a dye-donating substance for the colour diffusion transfer process, a chromogenic colour coupler, a DIR compound, a stabiliser, an antioxidant, a spectral sensitiser, a desensitiser, a UV absorber, a light stabiliser, a fluorescent brightener, a solubilising agent, a bleaching catalyst for the silver dye-bleach process, a developer or a crosslinking agent.

3. A process according to claim 1, wherein, in the dispersing assistants of the formula (1), $R_1$, $R_2$ and $R_3$ are each hydrogen or alkyl having 1 to 5 carbon atoms, at least one of these radicals being alkyl having at least 3 carbon atoms and the sum of the carbon atoms in these radicals being at least 4, $R_4$ is hydrogen or methyl and Z is hydrogen or $-P(O)Y_1Y_1$, in which $Y_1$ is a radical of the formula

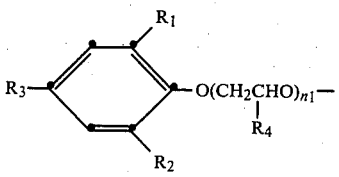

$R_1$, $R_2$, $R_3$, $R_4$ and $n_1$ are as defined in claim 1.

4. A process according to claim 1, wherein, in the dispersing assistants of the formula (2), $R_5$ to $R_8$ are each hydrogen or alkyl having 1 to 5 carbon atoms, at least two of these radicals being alkyl having, in each case, at least 3 carbon atoms and the sum of the carbon atoms in these radicals being at least 8, and $R_4$ is hydrogen or methyl and m is 2 and the sum of $(n_2+n_3)$ is 8 to 200.

5. A process according to claim 1, wherein, in the dispersing assistants of the formula (3), $R_9$ to $R_{14}$ are each chlorine or bromine and $R_4$ is hydrogen or methyl and m is 2 and the sum of $(n_4+n_5)$ is 8 to 200.

6. A process according to claim 1, wherein, in the dispersing assistants of the formula (4), $R_{15}$ to $R_{17}$ are each hydrogen or alkyl having 1 to 12 carbon atoms, at least one of these radicals being alkyl having at least 3 carbon atoms and the sum of the carbon atoms in these radicals being at least 4, and $R_4$ is hydrogen or methyl, $Z_1$ is $—SO_3M$ and $n_6$ is an integer from 1 to 50 and M is as defined in claim 1.

7. A process according to claim 1, wherein, in the dispersants of the formula (5), $R_{18}$ to $R_{21}$ are each hydrogen or alkyl having 1 to 5 carbon atoms, at least two of these radicals being alkyl having, in each case, at least 3 carbon atoms and the sum of the carbon atoms in these radicals being at least 8, and $R_4$ is hydrogen or methyl and m is 2, the sum of $(n_7+n_8)$ is 2 to 40 and $Z_1$ is $—SO_3M$, in which M is as defined in claim 1.

8. A process according to claim 1, wherein, in the dispersants of the formula (6), $R_{22}$ to $R_{27}$ are each chlorine or bromine, $R_4$ is hydrogen or methyl, m is 2 and $Z_1$ is $—SO_3M$, the sum of $(n_9+n_{10})$ is 2 to 40 and M is as defined in claim 1.

9. A process according to claim 1, wherein the dispersing assistants of the formulae (1) to (3) and those of the formulae (4) to (6) are employed in a weight ratio of (1:0.01) to (1:1).

10. A process according to claim 1, wherein the weight ratio of the photographic additive to the amount of dispersing assistants of the formulae (1) to (3) and (4) to (6) is (1:0.1) to (1:4).

11. A process according to claim 1, wherein the solvent (c) used is a water-immiscible solvent with a solubility parameter of not more than 13.

12. A process according to claim 11, wherein the solvent used is pentane, hexane, heptane, octane, nonane, decane, tetrahydronaphthalene, decahydronaphthalene, cyclohexane, benzene, toluene, xylene, chlorobenzene, bromobenzene, dichlorobenzene, nitrobenzene, methylene chloride, chloroform, carbon tetrachloride, trichloroethylene, butanol, pentanol, hexanol, cyclohexanol, ethyl acetate, propyl acetate, butyl acetate, amyl acetate, ethyl propionate, cyclohexanone, methyl isobutyl ketone, acetonitrile, ethoxyethanol, tricresyl phosphate or dibutyl phthalate.

13. A process according to claim 1, wherein the water-soluble hydrophilic colloid used is gelatin, casein, a water-soluble derivative of cellulose or another high-molecular weight carbohydrate, an alginate, polyvinyl alcohol, polyvinylpyrrolidone, polyvinyl methyl ether or a graft copolymer of gelatin with a water-soluble ester of acrylic acid, methacrylic acid, maleic acid or itaconic acid.

14. A process according to claim 1, wherein the weight ratio of the water-insoluble phase (photographic additive/dispersing assistant and, if desired, solvent) to the aqueous colloid solution is between (1:5) and (1:100).

15. A process according to claim 1, wherein the fine dispersion of the water-insoluble (oily) phase in the aqueous phase is effected by simple stirring, shaking, by means of a static mixer or by means of a low-frequency mixer.

16. A process according to claim 1, wherein volatile solvents are recovered, by evaporation, from the water-insoluble (oily) phase before or after this has been finely dispersed in the aqueous phase.

17. A free-flowing aqueous preparation prepared by the process of claim 1, for the preparation of a photographic layer.

18. An aqueous preparation according to claim 17, wherein the particle size distribution of the photographic additives contained therein follows a Poisson function.

19. A photographic layer prepared using a preparation according to claim 17.

20. Photographic material which contains one or more layers according to claim 19.

* * * * *